United States Patent [19]

King et al.

[11] 4,047,272

[45] Sept. 13, 1977

[54] MACHINE FOR CONTINUOUS BIAS CUTTING OF TUBULAR FABRIC

[75] Inventors: J. Frank King; Donald A. Sloan, both of Winston-Salem, N.C.

[73] Assignee: Hanes Corporation, Winston-Salem, N.C.

[21] Appl. No.: 644,569

[22] Filed: Dec. 29, 1975

[51] Int. Cl.[2] ..... B21D 43/00; B26D 3/16; B65H 17/08

[52] U.S. Cl. ..... 29/2.19; 29/2.2; 242/65

[58] Field of Search ..... 29/2.1–2.24, 29/2.25; 83/178, 180, 187, 425.3, 505, 506; 242/57, 65

[56] References Cited

U.S. PATENT DOCUMENTS

| | | | |
|---|---|---|---|
| 1,356,485 | 10/1920 | Bunker | 29/2.13 |
| 1,659,453 | 2/1928 | Berry | 29/2.15 |
| 1,753,645 | 4/1930 | Camfield | 29/2.19 |
| 1,896,596 | 2/1933 | Seddon | 29/2.15 |
| 1,955,282 | 4/1934 | Gardner et al. | 29/2.23 |
| 2,110,856 | 3/1938 | Gardner et al. | 29/2.21 X |
| 2,644,522 | 7/1953 | Parker et al. | 29/2.21 X |
| 2,796,933 | 6/1957 | DeGelleke | 83/506 |
| 2,895,596 | 7/1959 | Kuypers | 290/2.15 |
| 2,985,944 | 5/1961 | Judelson | 29/2.2 |
| 3,026,599 | 3/1962 | Leff | 29/2.16 |
| 3,114,193 | 12/1963 | Lynam | 29/2.17 |
| 3,734,307 | 5/1973 | DeGelleke et al. | 242/65 X |

*Primary Examiner*—Othell M. Simpson
*Attorney, Agent, or Firm*—Robert B. Frailey

[57] ABSTRACT

Automated machine for the continuous bias cutting of an elongated tube of material, such a tubular knitted fabric, into a plurality of individual strips, and winding the strips into a plurality of rolls of fabric. The machine comprises a supply section, a spreading and tensioning section and a cutting and rolling section. The tubular material or fabric is stored in the supply section in a rotatable receptacle in the form of a stack of untensioned superimposed flattened folds. The tube is advanced axially from the supply to the cutting and rolling section of the machine by a plurality of skewed rotatable cylinders. As the flattened tube is withdrawn from the supply, it passes over a spreader which opens and tensions it. The rotatable skewed cylinders cause the advancing tube to rotate about its axis as it advances to be cut into strips. Selectively operable control means are utilized for rotating the supply receptacle, to correlate its speed of rotation with the speed of rotation of the tube of material, to maintain the tube substantially untwisted, relative to its axis, and under substantially uniform tension, as it advances to the cutting and rolling section of the machine.

14 Claims, 9 Drawing Figures

MACHINE FOR CONTINUOUS BIAS CUTTING OF TUBULAR FABRIC

SUMMARY OF THE INVENTION

This invention comprises an improved machine for the continuous bias cutting of an elongated tube of material, such as tubular knitted fabric, into a plurality of individual strips, and winding the strips into rolls. The improved machine of this invention eliminates wastage of the tubular material to be cut, while providing means for cutting it into plural strips of uniform width. A spiral type cutter is used, having a plurality of rotatable crush-cutting blades each of which continuously cuts the tubular material in the form of a helix, thereby producing a plurality of continuous lengths of helical cut strips of material. A primary use of the machine is to cut tubular knitted fabric into binding material for garments.

The primary object of this invention is to provide a new and improved automated machine for the continuous bias cutting of tubular material into a plurality of continuous strips of uniform width, having cut edges of uniform smoothness, without wastage of the material.

A further object of the invention is to provide a novel tube advancing means for advancing the tubular material axially from a source of supply to a plurality of cutters, for cutting the material into strips, while maintaining the tubular material substantially untwisted relative to its axis during its advancement.

A further object is to provide selectively controllable tube advancing means for advancing the tubular material axially under uniform tension as it passes from the source of supply to the cutters.

A further object is to provide novel advancing means for advancing the tubular material from the source of supply to the cutters which includes a plurality of skewed, rotatable cylinders and a spreader for opening and tensioning the tube as it passes to the cylinders.

To achieve the foregoing objectives, the tubular material is stored in untensioned condition in the form of a stack of flattened, superimposed folds in a rotatable receptacle, and is advanced axially from the receptacle to cutting and rolling means by a plurality of rotatable, skewed cylinders, which rotate the tube as it advances. As the tube is withdrawn from the receptacle by the cylinders, it passes over a spreader which opens and selectively tensions the advancing tube. Speed control means are provided to correlate the speed of rotation of the supply receptacle with the speed of rotation of the tube about its axis, as it is advanced by the skewed cylinders to the cutting and rolling section of the machine.

Other objects and advantages of this invention will be readily apparent from the following description of a preferred embodiment thereof, reference being had to the accompanying drawing.

DETAILED DESCRIPTION OF THE INVENTION

Figure 1:
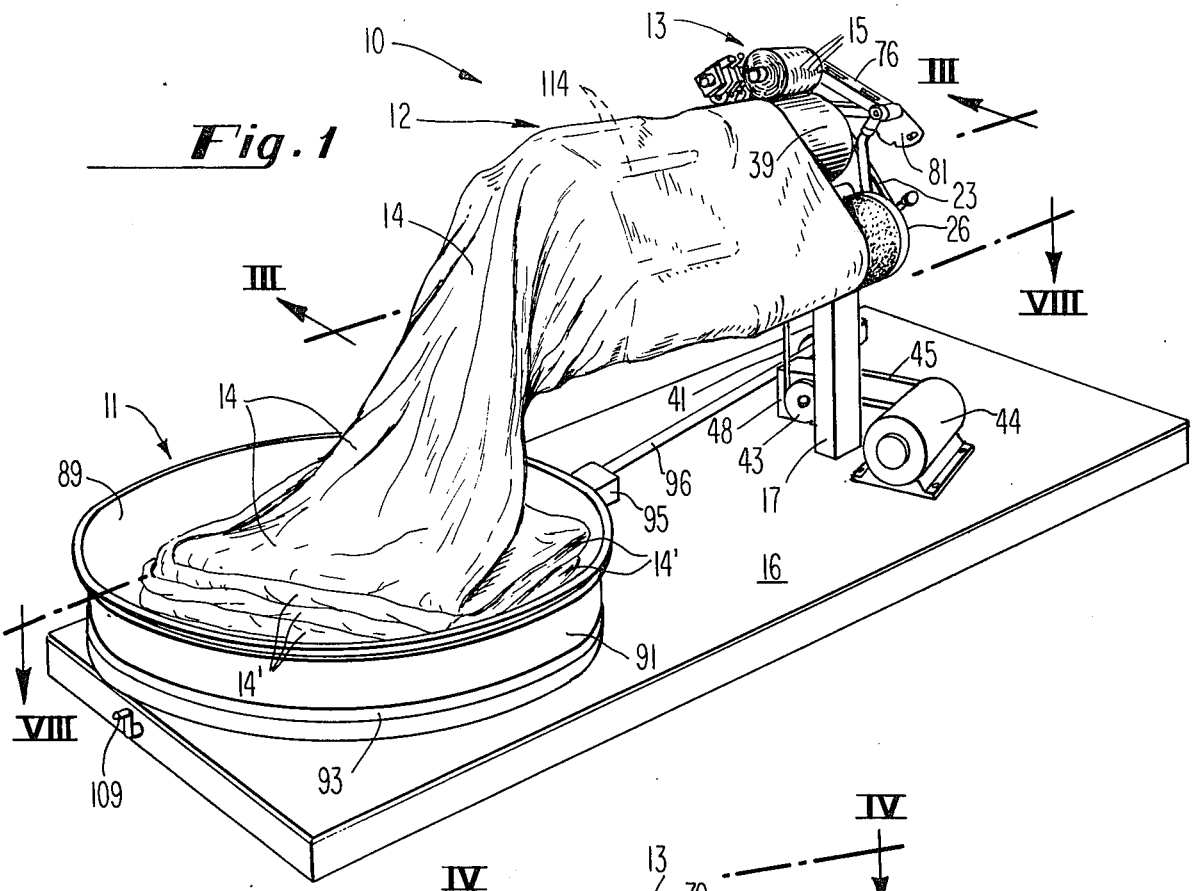
FIG. 1 is a view in perspective showing a preferred fabric cutting machine of this invention in the process of cutting tubular fabric into plural strips and winding the cut strips into rolls.
Figure 2:
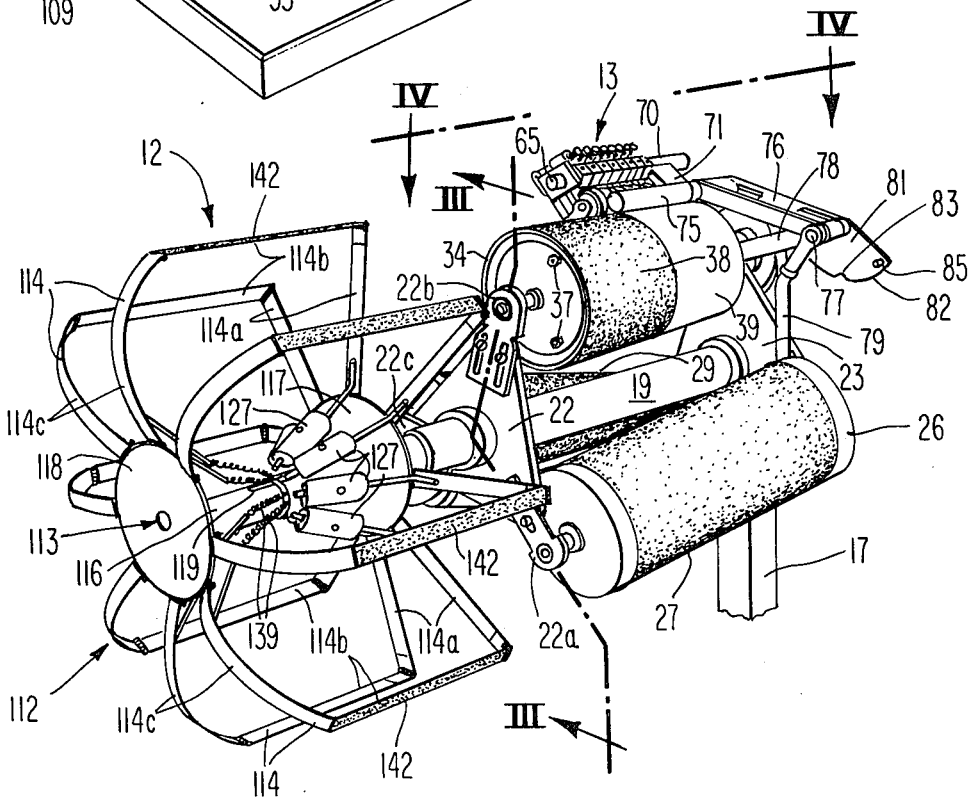
FIG. 2 is an enlarged, fragmentary view in perspective showing the upper portion of the machine with the fabric removed.
Figure 3:
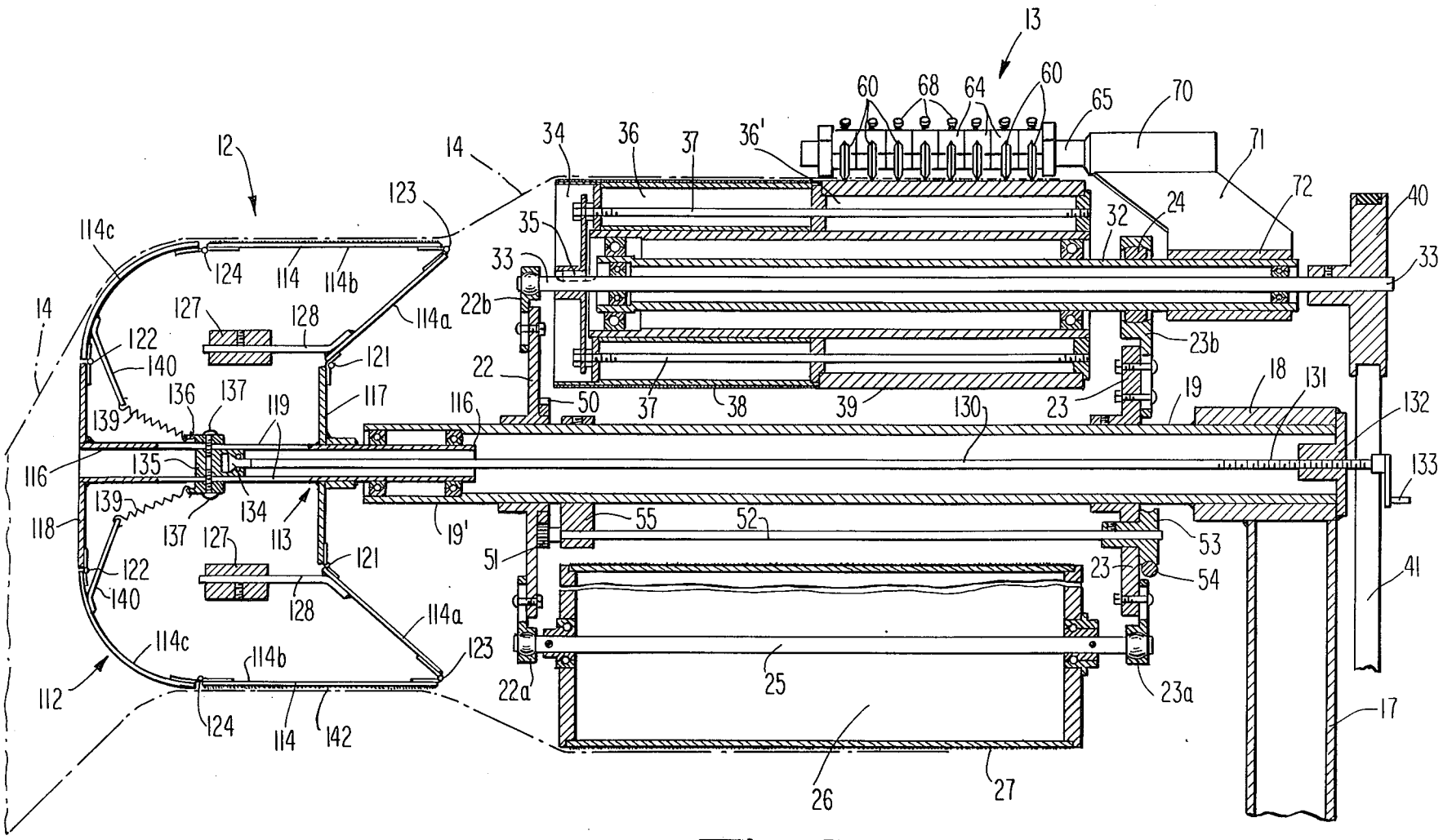
FIG. 3 is an enlarged, fragmentary view in section indicated by the arrows III—III of FIG. 2, and also by the arrows III—III of FIG. 1.

Referring first to FIGS. 1 to 3 inclusive, there is illustrated a preferred machine 10 of this invention for cutting a continuous tube 14 of seamless knitted fabric into a plurality of individual, helically cut, continuous strips, and forming the cut strips into a plurality of separate rolls 15. The machine 10 is composed of a fabric supply section 11, a fabric spreading and tensioning section 12 and a fabric cutting and rolling section 13. The machine is supported by a base structure which includes a vertical standard or support 17 affixed rigidly to a horizontal base or bed 16. Affixed to the top of standard 17 is a horizontal axis collar 18 (FIG. 3). Secured rigidly within collar 18 is one end of an elongated, horizontal, tubular support shaft 19. The base 16, standard 17, collar 18 and shaft 19 comprise the basic supporting structure of the machine 10. The axis of support shaft 19 is coincident with the longitudinal axis of the machine.

Mounted externally on the hollow shaft 19 are a pair of horizontally spaced, vertical end plates 22, 23 of generally equilateral triangular configuration. Secured to the three radially disposed apices of end plate 22 are adjustable brackets *22a, 22b, 22c,* each of which mounts at its distal end a conventional ball joint. In similar fashion, there is mounted at the radially disposed apices of end plate 23 adjustable brackets *23a, 23b, 23c* (FIG. 5), each of which also supports a conventional ball joint. The brackets are releasably secured to their end plates 22, 23 by any suitable means, such as threaded bolts (FIGS. 2, 5), whereby the brackets are rendered axially adjustable. Thus, the brackets may be located selectively in fixed positions on their end plates 22, 23, in radially spaced relationship to the center shaft 19.

Each of the three ball joints of end plate 22 are disposed in opposing relation to one of the three ball joints of end plate 23. The arrangement provides three pairs of spaced ball joints, with the joints of each pair being disposed generally horizontally to each other. The end plate 22 is movable angularly relative to the axis of shaft 19, but end plate 23 is secured rigidly to shaft 19 by any suitable means, such as a set screw. As will be explained, end plate 22 is adjustable angularly to displace, angularly and selectively, its ball joints relative to the opposing ball joints of end plate 23.

The spaced ball joints of brackets *22a, 23a,* support a stationary shaft 25 on which is mounted a rotatable cylinder 26, the outer periphery of which is provided with a roughened friction surface 27 of any conventional material (FIG. 3). Similarly, the spaced ball joints of brackets 22c, 23c support a stationary shaft 28 on which is mounted a rotatable cylinder 29 (FIGS. 2, 5), the outer periphery of which is covered with a friction material 30. The cylinders 26, 29 are supported on their shafts 25, 28 by conventional ball bearings, and hence are freely rotatable on their respective shafts.

As best illustrated in FIG. 3, the ball joint 24 of bracket 23b supports a non-rotatable tubular shaft 32. Disposed within the hollow of shaft 32 are a pair of horizontally spaced ball bearings which support, internally of shaft 32, a rotatable shaft 33. Affixed to the right hand end of shaft 33, as viewed in FIG. 3, is a timing pulley 40, by which rotation is imparted to shaft 33. The opposite end of shaft 33 is mounted in the ball joint supported by bracket 22b. A rotatable cylinder 34 is keyed to the shaft 33 at 35. The cylinder 34 is composed of axially aligned cylinder segments 36, 36', which are rigidly secured together, in co-axial relationship, by means of three elongated bolts 37. The periphery of the cylinder segment 36 is covered by a friction material 38, whereas the periphery 39 of the cylinder segment 36' is formed of hardened steel.

Figure 8:
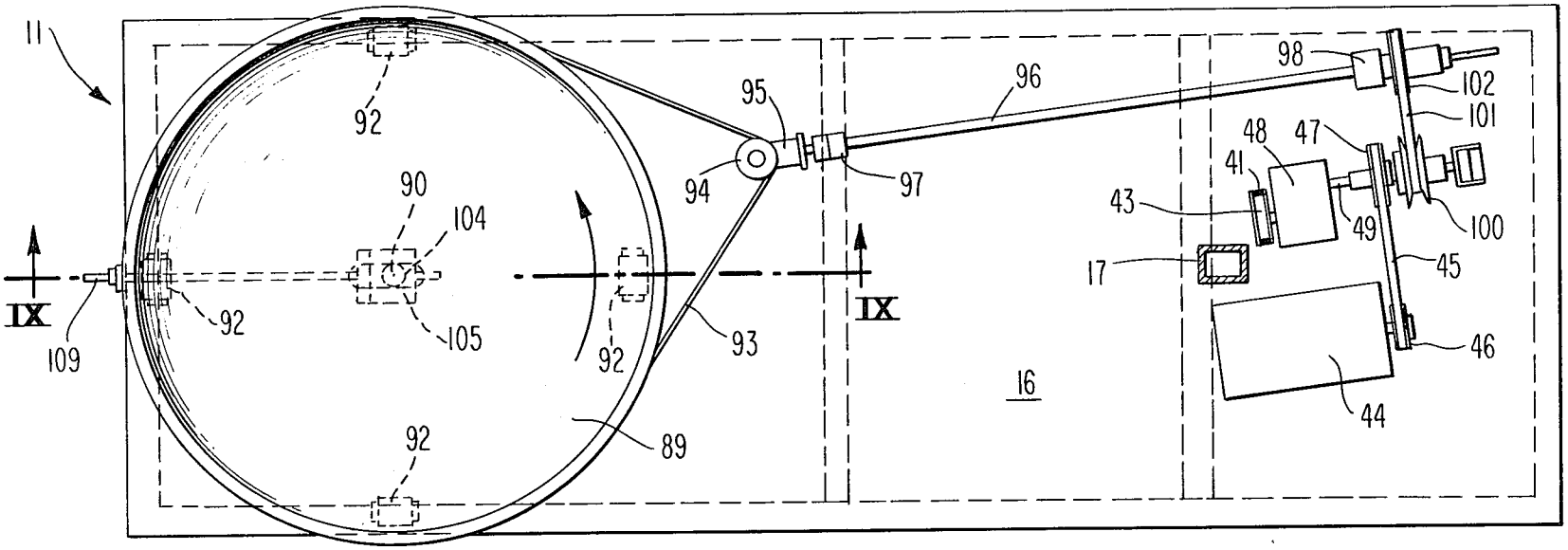
FIG. 8 is an enlarged plan view in section indicated by the arrows VIII—VIII of FIG. 1, with the fabric removed.

Timing pulley 40 is driven rotatably by timing belt 41, to impart rotation to cylinder 34 via shaft 33 and the key connection 35. Timing belt 41 passes over an idler pulley 42 (FIG. 5) and extends downwardly about a timing pulley 43 (FIG. 8). A motor 44 drives timing pulley 43 via a drive system which includes belt 45, pulleys 46, 47, gear reducer 48 and suitable interposed shafting, including shaft 49 on which pulley 47 is mounted.

The cylinders 26, 29, 34 are mounted in a generally equilateral triangular pattern around the axis of the center shaft 19. Initially, in setting up the machine 10, the three cylinders and their respective shafts 25, 28, 33, preferably are disposed in horizontal, parallel relation, as indicated in FIG. 3. The cylinders 26, 29, 34 may be adjusted radially relative to the fixed support 19 by the inward or outward radial adjustment of brackets 22a, 22b, 22c, 23a, 23b, 23c relative to their respective end plates 22, 23. Thus, the three cylinders may be located, relative to the longitudinal axis of the machine 10, to accommodate the diameter of the tubular fabric 14. Each of the cylinders 26, 29, 34 should be spaced radially from the longitudinal axis of the machine by a distance sufficient to spread the fabric tube and retain it under a constant, predetermined tension, to ensure accurate and reliable cutting of the fabric into continuous strips.

Figure 5:
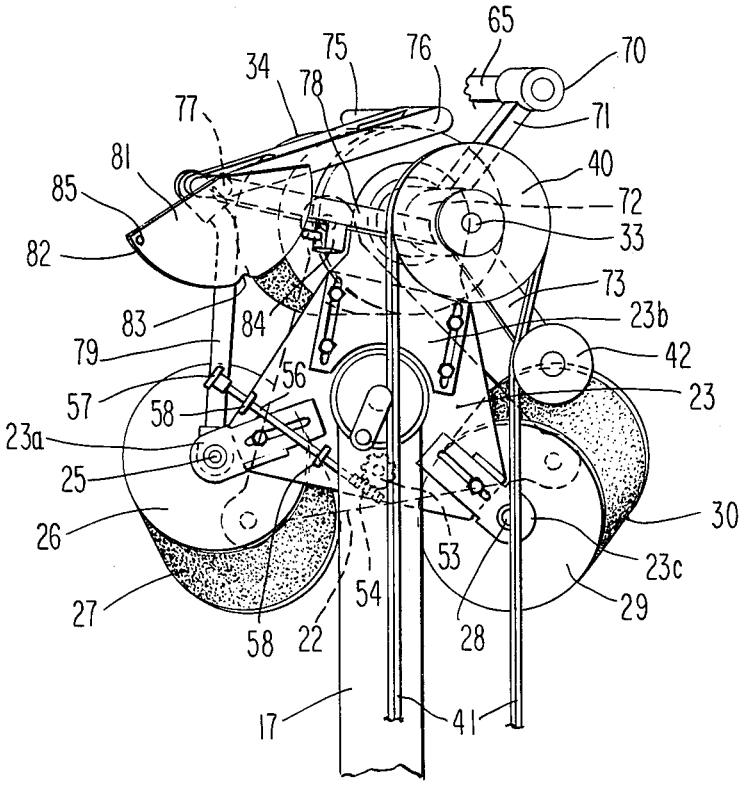
FIG. 5 is a fragmentary view in elevation indicated by the arrows V—V of FIG. 4.
Figure 6:
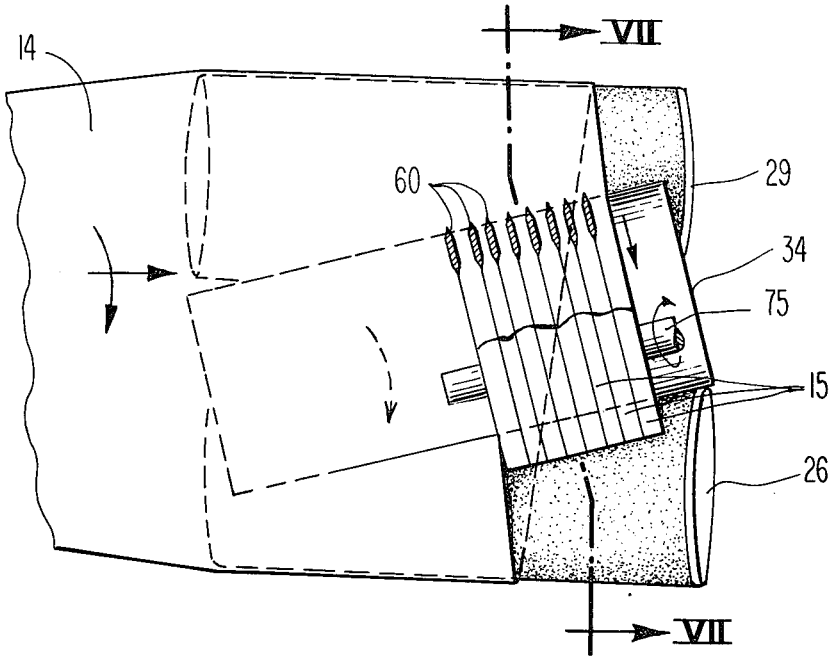
FIG. 6 is a partly schematic, fragmentary view in plan snowing the machine in the process of cutting fabric into strips, and the strips of fabric being formed into individual rolls of fabric by a take-up mandrel.
Figure 7:
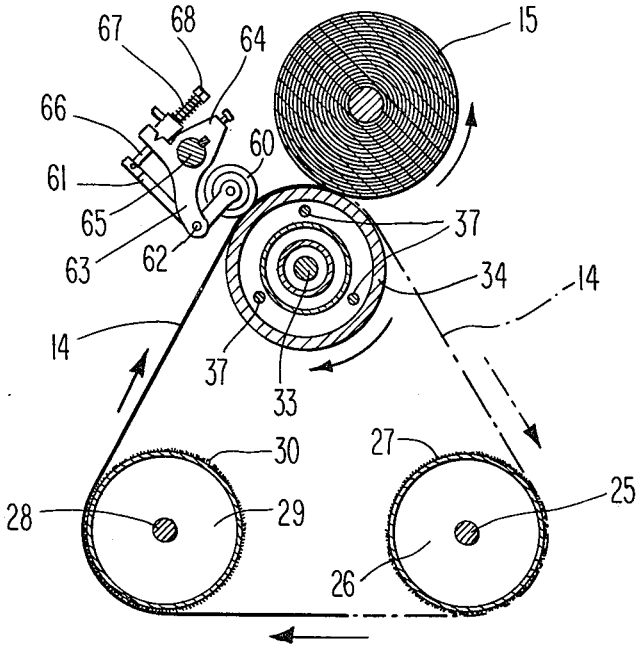
FIG. 7 is a sectional view indicated by the arrows VII—VII of FIG. 6.

In preparing the machine 10 for fabric cutting operation, the cylinders 26, 29, 34 also are adjusted so their shafts 25, 28, 33 are skewed relative to each other and also relative to the longitudinal axis of the machine. FIGS. 1, 2, 4, 5 and 6 illustrate the three cylinders disposed in skewed position. Skewing the cylinders permits them to act as a positive feeding means for the tubular fabric 14, to advance the fabric tube at a uniform rate from the fabric tensioning section 12 of the machine to the fabric cutting section 13. The advancing fabric is caused to move circumferentially about its tubular axis by the driven cylinder 34 (FIG. 7). Since the idler cylinders 26, 29 are freely rotatable, rotational drive is imparted to them by the rotating tube of fabric 14. The friction surfaces 27, 30, 38 on the skewed cylinders 26, 29, 34 ensure that the fabric tube 14 is advanced without slippage to the cutting section 13 of the machine (FIGS. 1, 6).

In the preferred embodiment illustrated, the cylinder 34 is power driven, and the freely rotatable idler cylinders 26, 29 are rotated by the revolving tube of fabric 14, as it advances to the fabric cutting section 13 of the machine. However, it is within the scope of this invention to provide suitable drive transmission means between the cylinders, whereby the cylinder 34 imparts positive drive to cylinders 26, 29. This may be accomplished, for example, by connecting the power driven cylinder 34 to the cylinders 26, 29 by suitable universal joints and gearings, or by other conventional means, such as suitable sprocket and chain drives. The imposition of drive means between the driven cylinder 34 and cylinders 26, 29 is particularly advantageous where the machine 10 is used for the slitting of relatively delicate tubular fabrics.

It also is to be understood that the employment of both cylinders 26, 29 may not be necessary in all uses of the machine. In some installations, a two-cylinder arrangement will suffice. Where two cylinders are utilized, one may be a driven cylinder and the other an idler cylinder rotated by the revolving tube of fabric 14. Alternatively, the latter also may be a driven cylinder, receiving its rotational drive from a power driven cylinder such as cylinder 34. In either such arrangement, skewing of the two cylinders enables them to act as a positive feeding means for advancing the tubular fabric 14 to the cutting section 13 of the machine.

The cylinders 26, 29, 34 are rendered skewable relative to each other and relative to the machine axis by the ball joints which support their respective shafts 25, 28, 33. Skewing of the cylinders is accomplished by angular movement of end plate 22 about the axis of support shaft 19. Adjustment means for accomplishing selective skewing of the cylinders includes an annular gear 50 (FIG. 3) affixed to the internal face of end plate 22 and a pinion 51 meshing with gear 50 and affixed to one end of an elongated rod 52. Affixed to the opposite end of rod 52 is a helical gear 53 which meshes with a worm 54. As shown in FIG. 5, worm 54 is disposed at the inner end of a stem 56, which is supported turnably on plate 23 by spaced brackets 58. The outer end of stem 56 is provided with a hand wheel 57. Selective turning of the hand wheel 57, in either angular direction, causes pinion 51 to move annular gear 50 to adjust selectively the angular position of end plate 22 relative to support 19. Selective adjustment of end plate 22 determines the skew angle at which the cylinders 26, 29, 34 are disposed relative to the machine 10.

Rod 52 is supported rotatably adjacent end plate 22 by a bracket 55 depending from shaft 19. At the opposite end, rod 52 is affixed internally of the helical gear 53 which, in turn, is supported rotatably by end plate 23. The cylinder skewing means comprising hand wheel 57, stem 56, worm 54, helical gear 53, rod 52, pinion 51 and gear 50 may be operable to dispose the cylinders at any desired skew angle relative to the fixed support tube 19. In practice, it has been found that highly satisfactory fabric cutting results are achieved with a cylinder skew angle on the order of 10° relative to the longitudinal axis of the machine.

The forward portion of the advancing tube of fabric 14 is bias cut into a plurality of continuous spiral strips of fabric, to be formed into the several separate fabric rolls 15, by a plurality of axially spaced, spring loaded rotatable crush cutting rollers 60 (FIGS. 3, 6, 7). As best illustrated in FIG. 7, each cutting roller 60 is mounted rotatably at the bifurcated inner end of a bell crank 61 pivotally supported at 62 adjacent the lower end of a depending arm 63 of a bracket 64. Pivotally secured at the outer end of bell crank 61 is a pin 66 slidably supported by bracket 64, with capacity for axial movement. The threaded upper end of pin 66 engages an internally threaded nut 68. A coil spring 67 surrounds the upper end of pin 66, and is disposed between the bracket 64 and the threaded nut 68. A separate bracket assembly, composed of bracket 64, bell crank 61, pin 66, spring 67 and nut 68 is provided for each separate cutter roller 60. Each of the brackets 64 is affixed by suitable means, such as a key, to a stud shaft 65 disposed parallel to shaft 33 of cylinder 34.

As illustrated in FIG. 3, the circular cutting edges of the rollers 60 engage the hardened steel periphery 39 of cylinder 34. The cutting rollers 60 are spring-biased against the surface 39 of cylinder 34 by means of the coil springs 67. As will be understood, the degree of spring tension may be varied selectively by the axial adjustment of threaded nut 68, to create a greater or lesser force of contact between the cutting edges of rollers 60 and the hardened steel surface 39 of cylinder 34. The frictional contact between the periphery of driven cylinder 34 and the cutting rollers 60 causes the latter to rotate as the cylinder rotates. As a result, a plurality of individual continuous strips of fabric are cut from the advancing forward end of the fabric tube 14, as it passes to the cutting section 13. Because of the skewing of the cylinders, the fabric tube advances on the bias, relative to the gang of cutters 60, whereby the latter continuously cut the fabric into a plurality of separate helical strips (FIG. 6).

Figure 4:
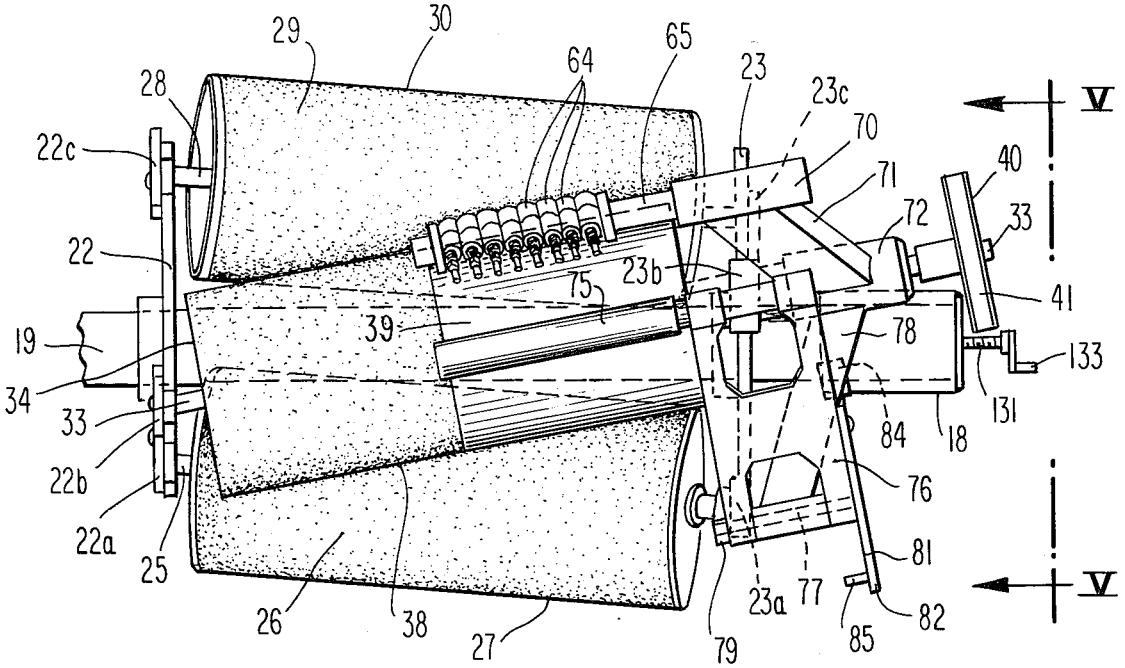
FIG. 4 is a fragmentary view in plan of the machine.

The stud shaft 65 is mounted in the distal end 70 of a bracket 71 affixed to a collar 72 (FIGS. 3, 4). Collar 72 is mounted externally of the stationary hollow support shaft 32, between end plate 23 and timing pulley 40.

In the drawing, a total of eight individual fabric cutters 60 are shown for the purpose of illustration. Utilizing eight cutters produces a total of eight strips of cut fabric, to be formed into eight individual rolls of fabric, generally designed at 15. It will be understood, of course, that any selected number of crush cutters may be utilized, to produce a plurality of continuous, bias cut strips of fabric. The cutters 60 preferably are disposed at uniformly spaced intervals along stud shaft 65. With such arrangement, the advancing fabric will be cut into plural strips of uniform width, with the possible exception of the first strip. The latter may be subject to slight width variations, if the machine does not feed the tubular fabric 14 to the cutters at a uniform rate at all times.

The cut strips of fabric are rolled up on, and formed into rolls by, a mandrel 75 (FIGS. 2, 4) rotatably supported in the distal end of an elongated swingable arm 76 pivotable about a stud shaft 77. The stud shaft 77 is supported by a pair of brackets 78, 79. Bracket 78 is affixed to the collar 72 (FIG. 5), and extends outwardly therefrom, having stud shaft 77 affixed in its distal end. Bracket 79 is affixed to one end of the stud shaft 77, and extends downwardly and has its lower end secured at some suitable location to the machine 10. For example, as illustrated in FIG. 5, the lower end of bracket 79 may be engaged with a yoke disposed about cylinder shaft 25 in the space between cylinder 26 and bracket 23*a*.

Affixed to the swingable arm 76 is a quadrant 81, the outer arcuate edge 82 of which provides a curved cam having an intermediate notch 83. Cam edge 82 is adapted to engage, for a purpose to be explained, the protruding end of the outwardly biased actuator of a microswitch 84 mounted on bracket 78. The microswitch 84 may be of any conventional construction, and preferably is provided with an axially movable, spring-biased actuator having a conventional cam follower roller (not shown) affixed to its outer end. Preferably, the cam follower roller of the microswitch actuator remains continuously in engagement with the cam edge 82 of the quadrant 81.

Preparatory to the operation of the machine, mandrel 75 rests against the hardened steel surface 39 of the cylinder 34 (FIGS. 2, 4). The mandrel is disposeed parallel to the rotatable shaft 33 of the driven cylinder 34, and is spaced arcuately a small distance from the crush cutting rollers 60. The frictional surface contact between the hardened steel periphery 39 of the cylinder 34 and the mandrel 75 causes the mandrel to rotate.

At the outset of the cutting operation, the free ends of the cut strips are wrapped manually on the mandrel 75, to start the roll forming process. Thereafter, the rotation of the mandrel 75 causes the cut fabric strips passing from the gang of cutters 60 to roll up on the mandrel. As the machine operates, the strips of cut fabric are wound automatically and continuously on to the rotatable mandrel 75, to be formed into the individual rolls 15 of the fabric (FIGS. 1, 2, 6, 7). The collective weight of the mandrel 75, arm 76 and quadrant 81 maintains the several fabric rolls 15 firmly in contact with the cylinder surface 39. This enables the expanding rolls of fabric on the rotatable mandrel to continue to be surface driven by the rotating cylinder 34.

The arcuate proximity of the cutters 60 to mandrel 75 ensures that the cut strips of fabric do not separate from the cutting surface 39 in the arcuate distance between the cutters and the mandrel, until the cut strips are wound onto the individual rolls 15. By maintaining the cut fabric strips in contact with the periphery 39 from the time of cutting until rolled into roll form, tension control of the fabric strips is carefully maintained. This ensures that high quality, substantially uniformly wound rolls of cut fabric strips are produced. In cutting tubular fabric into strips of binding material for garments, it is important that uniform smoothness of the cut edges be achieved, and that the strips of fabric be formed into rolls under a constant tension. The fabric cutting machine of this invention achieves these highly desirable results.

As the fabric rolls 15 progressively increase in size, the mandrel 75 and its arm 76 gradually swing outward, away from cylinder 34, about pivot 77. As the arm 76 pivots outwardly, the curved cam edge 82 of quadrant 81 rides along the outer protruding end of the spring-biased actuator of the microswitch 84 (FIGS. 4, 5). When the rolls 15 have reached a predetermined size, e.g. twelve inches in diameter, the notch 83 in the cam edge 82 of the quadrant 81 engages the outer end of the microswitch actuator. At this juncture, the spring-biased actuator advances into the notch 83, activating the switch to stop operation of the machine 10. Thereupon, the several rolls 15 of the strips of fabric are removed from the mandrel 75. The bare mandrel then is swung back into contact with the surface 39 of the cylinder 34, preparatory to the next operative cycle of the machine. Of course, as will be readily understood, the operative relationship between notch 83 and microswitch 84 is selectively adjustable, to vary as desired the diametric size of the rolls of fabric 15. A pin 85 extends outwardly from the inner face of the quadrant 81, adjacent its arcuate edge 82. The pin 85 is disposed to contact the bracket 78, when mandrel arm 76 is swung outwardly from the cylinder 34 a selected distance.

Thus, pin 85 acts as a stop and limits the arcuate displacement of mandrel 75 away from the machine. It provides means whereby the mandrel may be conveniently located away from the cylinder 34, to enable the fabric rolls 15 to be doffed easily from the mandrel. After the fabric rolls have reached predetermined size, and switch 84 has stopped operation of the machine, the mandrel arm 76 may be swung outwardly to the extent permitted by pin 85, preparatory to removing the fabric rolls from the mandrel.

In the embodiment of the invention shown, the several fabric rolls 15 are removed manually from the mandrel 75, following the completion of an operative cycle of the machine 10. If desired, however, suitable automatic unloading mechanism may be provided, to render completely automatic the doffing of the fabric rolls 15 from the machine. Such unloading device automates the manual motions performed by a machine operator, in removing the fabric rolls 15 from the mandrel 75 and preparing the machine 10 for its next cycle of operation.

As best shown in FIG. 5, bracket 73 also is affixed to collar 72, and supports idler pulley 42 at its distal end. Because the non-rotatable tubular shaft 32 is supported by ball joint 24, it necessarily is skewed in harmony with the cylinders 26, 29, 34 and their shafts 25, 28, 33, upon the angular displacement of end plate 22. Since the tubular shaft 32 supports the rotatable cylinder shaft 33, and rigidly mounts collar 72, to which brackets 71, 73, 78 are affixed, the entire assembly including timing pulleys 40, 42, cutters 60 and mandrel 75 are skewed in harmony with cylinder 34 (FIGS. 4, 5).

Figure 9:
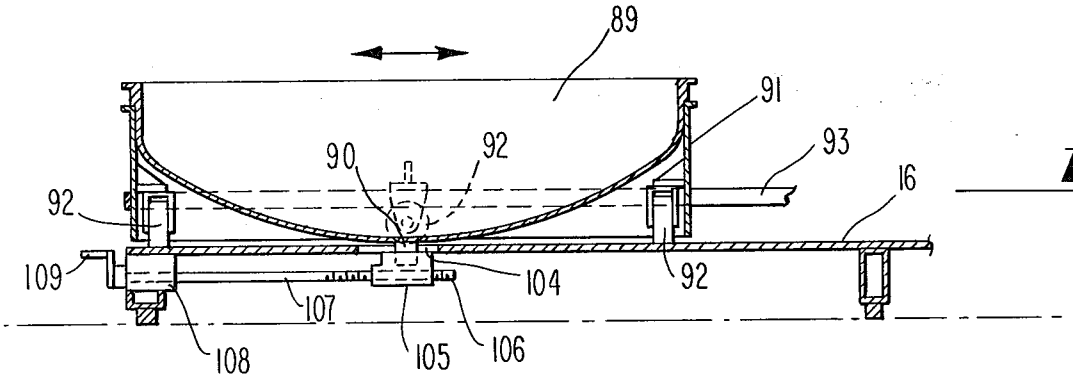
FIG. 9 is a fragmentary view in section indicated by the arrows IX—IX of FIG. 8.

Referring now to FIGS. 1, 8 and 9, it will be seen that the fabric supply section 11 of the machine 10 includes a substantially horizontal bowl-shaped receptacle or tray 89 for receiving the fabric tube in the form of a package of multiple superimposed, rectangular folds 14'. The fabric tray 89 is retained securely in a rotatable support cylinder 91 mounted vertically on a plurality of circumferentially spaced rotatable wheels or rollers 92 supported by the base 16 of the machine. Rotation is imparted to the support cylinder 91, and hence to fabric tray 89, by means of a drive belt 93 driven from a pulley 94.

Fabric tray 89 is provided at its bottom with a centrally located depending pin 90 (FIG. 9), which extends through a longitudinal slot 104 in the base plate 16, and engages snugly within a complemental vertical aperture formed in the upper portion of a horizontally adjustable nut 105. The centrally disposed pin 90 provides the vertical axis of rotation for the fabric tray 89 and its support cylinder 91.

Variable speed pulley 94 is connected to a drive shaft 96 by means of an interposed gear box or gear reducer 95. Shaft 96 is supported rotatably by spaced bushing supports 97, 98. Motor 44 drives shaft 96 by means of a drive system which includes pulleys 46 and 47, belt 45, shaft 49, variable diameter pulley 100, belt 101 and variable diameter pulley 102, the latter being secured to shaft 96.

Nut 105 is provided with an internally threaded horizontal aperture which engages the inner threaded end 106 of a horizontal rod 107. The opposite end of rod 107 is supported rotatably within a horizontal aperture formed in bracket 108. Rod 107 extends outwardly from bracket 108, where it is provided with a handle 109.

Nut 105, rod 107 and handle 109 provide adjustment means for moving the fabric tray 89, and its cylindrical support 91, longitudinally as indicated by the arrow in FIG. 9. Longitudinal adjustment of tray 89 and support cylinder 91 is rendered possible by the axial adjustability of the opposing spring-loaded flanges or halves of variable speed pulley 94. Axial movement of the rod 107 causes the variable diameter pulley 94 to open or close, depending on the direction of movement of the rod, to thereby vary the speed of drive belt 93. Thus, the speed of rotation of the fabric supply tray 89 may be carefully controlled, as necessary or desired, by the selected longitudinal adjustment of nut 105 and the consequent longitudinal displacement of tray 89 and cylinder 91.

To secure optimum results, it is essential that the advancing tubular fabric 14 remain untwisted with respect to its axis, and also be uniformly tensioned, during its passage from the fabric supply 11 to the cutting section 13 of the machine. To realize this desideratum, it is essential that the fabric supply be as tension-free as possible. This is achieved, first, by providing the tubular fabric 14 in a plurality of stacked, untensioned, rectangular folds 14' in the supply tray 89, and then by correlating the speed of rotation of the tray 89 with the rate of rotational speed imparted to the advancing fabric tube by the cylinders 26, 29, 34. By correlating the speed of rotation of fabric supply tray 89 with the rotational speed imparted to the fabric by the cylinders, the fabric tube 14 will rotate uniformly, at a substantially constant surface speed throughout its entire length, from the point where it leaves the supply tray 89 to its advancing forward end being cut into plural fabric strips.

Heretofore, in spiral cutting machines for cutting tubular fabric into strips, the fabric supply has been in the form of rotatable rolls or bolts of fabric, which are unwound and transferred to the cutting section of the machine. Wound rolls of fabric inherently incorporate uneven and variable tensions, which necessary affect the accuracy and uniformity of the cutting of the fabric into strips. By providing a fabric supply in the form of a stack of untensioned superimposed flattened folds 14', such unwind tensions are eliminated, thereby permitting more reliable and more uniform cutting of the tubular fabric into strips.

Interposed between the fabric supply tray 89 and the cylinders 26, 29, 34, at the fabric spreading and tensioning section 12, is a freely rotatable, basket-like fabric spreader 112 (FIGS. 1–3). As the fabric tube 14 advances from the supply tray to the cylinders, it passes over the spreader 112, which opens the fabric. The fabric spreader 112 is composed of a central core 113 which supports a plurality of articulated, annularly spaced ribs 114.

The spreader core 113 includes a rotatable tubular support 116 mounted for rotation on roller bearings disposed within the distal end 19' of the horizontal tubular support shaft 19 of the machine. Affixed to tube 116 are a pair of axially spaced circular plates 117, 118. Formed in the wall of tube 116 are a plurality of circumferentially spaced, axially extending slots 119. The slots 119 correspond in number to the articulated ribs 114, and each slot 119 is disposed in a radial plane with one of the ribs 114.

Each of the ribs 114 is composed of three separate links or segments **114*a*, 114*b*, 114*c*. The several rib segments 114*a* and 114*c* are connected, at their respective inner ends, to circular plates 117, 118 by hinge-like joints 121, 122 (FIG. 3). The opposite ends of the rib segments 114*a*, 114*c* are connected to their respective intermediate segments 114***b* by hinge-like joints 123, 124. Such articulated construction of the plural ribs 114 provides a pantograph-like effect for the spreader 112. As a result, the freely rotatable fabric spreader 112 is rendered self-adjusting diametrically, to compensate for variations in diameter of the tubular fabric 14 passing from the fabric supply tray 89 to the rotatable cylinders 26, 29, 34. Since the fabric spreader is freely rotatable, it is caused to rotate about its horizontal axis by the revolving tube of fabric 14.

As best shown in FIG. 3, the rotatable support tube 116 of the spreader 112 is co-axial with the stationary support shaft 19 of the machine structure. Hence, the rotatable fabric spreader 112 is aligned axially with the longitudinal axis of the machine 10. The rib segments or links 114*a,* 114*b,* 114*c,* with their pivot points 121, 123, 124, 122, provide a watts linkage, the effect of which is to maintain the rotating outside links 114*b* of the spreader 112 continuously parallel to the longitudinal axis of the spreader.

To counteract the centrifugal force on the rib segments 114*b,* a plurality of weights 127 are provided. Each weight 127 is affixed to the distal end of a rod 128, the proximal end of which is affixed to one of the rib segments 114*a.* Each rib segment 114*a* supports one of the rods 128 with its attached weight 127. The plural individual weights 127 are arranged in a circle about the rotatable support tube 116 of the spreader 112.

The spreader 112 continuously exerts a selected constant, outwardly directed, longitudinal retarding tension on the interior of the open fabric tube 14, as the fabric advances to the cutters 60. To achieve this, there is provided, internally of, and co-axial with, the hollow support tubes 19, 116, an elongated rod 130 having its threaded end 131 supported within the correspondingly threaded aperture of a cap 132 affixed to the end of shaft 19 adjacent collar 18. The threaded end 131 of rod 130 extends outwardly beyond cap 132, where it is provided with a handle 133. By reason of the threaded engagement between the threads of rod end 131 and the internal threads of the cap 132, rod 130 may be advanced or retracted axially, relative to tubes 19, 116, by turning handle 133.

Formed at the opposite end of rod 130 is a knob 134 to which is secured a cylindrical core 135 disposed internally of support tube 116. Disposed externally of tube 116, in the same vertical plane as the core 135, is a ring 136. Ring 136 is affixed to the core 135 by a plurality of bolts 137 which extend through the slots 119 formed in support tube 116. The core 135 and ring 136 affixed to the end 134 of rod 130 are slidable axially relative to tube 116.

Mounted on each of the rib segments 114*c* is an inclined rod 140 which extends inwardly in the direction of the support tube 116. Affixed at the distal end of each rod 140 is one end of a coil spring 139, the opposite end of which is affixed to the ring 136. The springs 139 urge the articulated ribs 114 radially outward, thus tending to expand the spreader 112 diametrically. Axial movement of the core 135 and ring 136 relative to the support tube 116 will increase or decrease tension on the circle of springs 139, to vary selectively the degree of fabric tension exerted by the annularly spaced ribs 114. The core 135 and ring 136 may be selectively positioned axially, relative to tube 116, by turning the handle 133 of the adjustment rod 130. Thus, rod 130, under the control of handle 133, and core 135, ring 136, springs 139 and rods 140 provide adjustment means to vary selectively, as necessary or desired, the internal force or tension imposed by the spreader 112 on the advancing tube of fabric 14.

If desired, to aid in applying a uniform axial tension on the fabric tube 14, and to improve the uniformity of its feeding rate, the outer surfaces of the rib segments 114*c* may be provided with a suitable friction material 142. Such friction material also aids in eliminating the formation of wrinkles in the advancing fabric tube.

By reason of the articulated rib structure of the spreader 112, a selected, substantially uniform tension may be exerted on the fabric tube as it passes to the cutters 60. The arrangement provides the necessary compensation for variable hoop tensions in the fabric, and also for variable friction forces exerted on the fabric by the spreader, due to variations in the quality and texture of the fabric.

The preferred embodiment of this invention, illustrated by the machine 10, has only two rotatably driven parts, comprising the cylinder 34 and the supply tray 89, both of which are driven, through suitable drive means, from the common motor 44. As a result of the invention disclosed herein, it is possible to provide a novel, automated machine for continuously cutting an advancing tube of fabric into a plurality of spiral strips, and winding the strips up into individual rolls of fabric. Because of the precision controlled fabric delivery, cutting and rolling operations, highly uniform results are produced while eliminating fabric wastage. It is possible, for example, to produce continuously, without waste, a plurality of strips of garment binding material of uniform width throughout their entire length.

Although a preferred embodiment of this invention has been shown and described for the purpose of illustration, as required by Title 35 U.S.C. 112, it is to be understood that various changes and modifications may be made therein without departing from the spirit and utility of the invention or the scope thereof, as set forth in the appended claims.

We claim:

1. In a machine for continuously cutting an elongated tube of fabric into a plurality of individual helically cut strips and winding the cut strips into a plurality of fabric rolls, said machine including a support, fabric cutting and rolling means mounted on the support for cutting the fabric into strips and forming the strips into rolls, and a fabric supply spaced longitudinally from the support, the improvement comprising:

a. a plurality of skewable, longitudinally disposed, transversely spaced, rotatable cylinders mounted on the support for supporting the fabric tube in open condition and advancing the tubular fabric axially from the supply to the cutting means, b. drive means for driving rotatably at least one of the cylinders, to cause the tubular fabric to rotate about its axis as the fabric advances to the cutting means, c. adjustment means for skewing the cylinders selectively relative to the support, to cause the tube of fabric to advance to the cutting means at a selected rate of speed, d. a rotatable receptacle for storing the supply of fabric, e. drive means for rotating the receptacle, f. speed adjustment means for correlating the speed of rotation of the receptacle with the speed of rotation of the tube of fabric as the fabric advances to the cutting means and g. freely rotatable spreading means interposed between the receptacle and the cylinders to open and tension the fabric tube, said spreading means being rotated by the rotating and advancing tube of fabric to maintain the fabric under substantially uniform tension and to permit the fabric to remain substantially untwisted as it advances to the cylinders.

2. The machine of claim 1, wherein the cylinders and the spreading means are disposed internally of the advancing fabric tube, and each are radially adjustable to accommodate the tubular diameter of the fabric.

3. The machine of claim 1, wherein the spreading means is provided with tensioning means operative to apply a uniform retarding tension on the tube of fabric as it advances from the supply to the cutting means.

4. The machine of claim 1, wherein the cylinders and the spreading means are disposed internally of the advancing fabric tube, and having means for maintaining the tube of fabric substantially untwisted relative to its axis as the fabric advances to the cutting means, said means including:

a. variable speed drive means for rotating the receptacle at selected rates of speed, said variable speed drive means being operable to correlate the speed of rotation of the receptacle with the speed of rotation of a tube of fabric as the fabric advances to the cutting means, b. a plurality of annularly spaced articulated ribs supported by the spreading means and c. tensioning means associated with the articulated ribs operative to cause the ribs to exert selectively a uniform retarding tension on the tube of fabric as it advances from the supply to the cutting means.

5. A machine for continuously cutting bias strips from an advancing tube of material, while maintaining the material under selected uniform tension, including:

a. a supply of tubular material, b. a plurality of cutters for cutting the tubular material into a plurality of individual strips, c. a rotatable mandrel for winding the cut strips of material into plural rolls, d. at least two skewable, transversely spaced, rotatable cylinders for supporting the tubular material internally, maintaining the tubular material in open condition and advancing the tubular material axially from the supply to the cutters and e. adjustment means for skewing the cylinders selectively relative to each other, to cause the tube of material to advance to the cutters at selected rates of speed.

6. The machine of claim 5, further including control means operative to stop operation of the machine after the cut strips have been wound into rolls of selected size.

7. The machine of claim 5, wherein the cutters are rotatable, and both the rotatable cutters and the rotatable mandrel are surface driven from one of the cylinders, said cutters and mandrel being spaced arcuately relative to the periphery of the cylinder.

8. The machine of claim 7, wherein the cutters and mandrel are disposed in parallel proximity to each other, to maintain the cut strips contiguous with the cylinder periphery, under uniform tension, from the point where the material is cut into strips to the point where the cut strips are wound into rolls.

9. The machine of claim 5, further including a freely rotatable spreader interposed between the supply and the skewable cylinders.

10. The machine of claim 9, wherein the skewable cylinders and the spreader are disposed internally of the advancing tube of material.

11. The machine of claim 10, further including drive means for rotating at least one of the cylinders, whereby the advancing tube of material is caused to rotate about its axis as it advances to the cutters.

12. The machine of claim 11, further including means for maintaining the tube of material substantially untwisted relative to its axis as it advances to the cutters.

13. The machine of claim 11, further including:

a. a rotatable receptacle for the supply of tubular material and b. variable speed drive means for rotating the receptacle at selected rates of speed, c. said variable speed drive means being operable to correlate the speed of rotation of the receptacle with the speed of rotation of the tube of material as it advances to the cutters.

14. The machine of claim 11, further including means for maintaining the tube of material under uniform tension as it advances to the cutters, said means comprising:

a. adjustment means for adjusting the cylinders radially relative to the axis of the tube of material, b. a plurality of annularly spaced ribs mounted on the spreader, said ribs having capacity to be advanced and retracted radially relative to the axis of the tube of material, c. tension means for imposing tension on the ribs and d. tension adjusting means for varying selectively the degree of tension imposed by the tension means on the ribs.

* * * * *